US005813453A

United States Patent [19]

Brucher

[11] Patent Number: 5,813,453

[45] **Date of Patent: *Sep. 29, 1998**

[54] HEAT EXCHANGER FOR COOLING CRACKED GAS

[75] Inventor: Peter Brucher, Oranienburg, Germany

[73] Assignee: Deutsche Babcock-Borsig AG, Berlin, Germany

[ * ] Notice: The term of this patent shall not extend beyond the expiration date of Pat. No. 5,579,831.

[21] Appl. No.: 834,735

[22] Filed: Apr. 3, 1997

[30] Foreign Application Priority Data

Jun. 1, 1996 [DE] Germany ..... 196 22 139.0

[51] Int. Cl.[6] ..... F28F 9/02; F28F 9/04

[52] U.S. Cl. ..... 165/134.1; 165/76; 165/158

[58] Field of Search ..... 165/76, 134.1, 165/158, 178

[56] References Cited

U.S. PATENT DOCUMENTS

| | | | |
|---|---|---|---|
| 3,129,931 | 4/1964 | Stookey | 165/158 X |
| 4,182,408 | 1/1980 | Laber | 165/70 |
| 4,589,473 | 5/1986 | Kehrer | 165/1 |
| 4,700,773 | 10/1987 | Kehrer | 165/134.1 |
| 4,848,449 | 7/1989 | Brucher et al. | 165/160 |
| 5,035,283 | 7/1991 | Brucher et al. | 165/134.1 |
| 5,088,551 | 2/1992 | Brucher et al. | 165/134.1 |
| 5,425,415 | 6/1995 | Master et al. | 165/154 |
| 5,579,831 | 12/1996 | Brucher | 165/134.1 |

*Primary Examiner*—Allen J. Flanigan
*Attorney, Agent, or Firm*—Max Fogiel

[57] ABSTRACT

A heat exchanger for cooling cracked gas with several cooling pipes (4), each accommodated in an outer pipe (6). The cooling pipes are welded at each end to a water chamber (7 & 8) that supplies and receives a coolant. Each water chamber is in the form of a straight and solid component with separated round depressions (11) in it. Each depression accommodates a single cooling pipe. The diameter of the depression is as long as or longer than the inside diameter of the outer pipe. The depression has an annular base (12) with thinner residual walls in the vicinity of the ends of the cooling pipe. The straight and solid components that comprise the water chamber consist of individual sections (7.1, 7.2. & 7.3 and 8.1, 8.2, & 8.3), each with a single depression that accommodates a cooling pipe which are all fastened together.

5 Claims, 4 Drawing Sheets

HEAT EXCHANGER FOR COOLING CRACKED GAS

BACKGROUND OF THE INVENTION

The present invention concerns a heat exchanger for cooling cracked gas.

Cracking gas derives from the thermal cracking of hydrocarbons in a cracking furnace. Such furnaces are provided with a number of externally heated cracking pipes. Accompanied by steam, the hydrocarbons travel through the pipes. The cracked gas leaves the pipe at approximately 800° to 850° C. and must be cooled very rapidly to stabilize its molecular composition. This is accomplished in coolers by transferring the heat of the gas to water that is evaporating subject to considerable pressure.

The straight component comprising the water chamber in a heat exchanger disclosed in the prior art is continuous. Although the design has been proven practical, problems occur when for conceptual reasons the distance between the furnace's pipes, which the distance between the pipes in the heat exchanger must match, is very short. Enough access to weld the pipes into a water chamber can no longer be ensured from a particular distance downward.

SUMMARY OF THE INVENTION

The object of the present invention is to improve the heat exchanger of the prior art to the extent that the pipes can be closer together and that it will be easier to maintain and repair.

Each individual section of the straight component in the heat exchanger in accordance with the present invention can be welded separately to its associated two-pipe component, allowing all-around access. Each section can in the extreme case be as long as the outside diameter of the outer pipe. The pipes can accordingly be as close together as desired. Once they have been provided with their associated two-pipe components, the sections can be combined into a rigid module. The division of the straight component into separate sections in accordance with the present invention can be facilitated by providing each two-pipe component with its own coolant intake and outlet. There is another advantage to this approach in that the sections can later be removed for maintenance and repair along with their associated two-pipe components. The sections can be attached together by welding, threading, or insertion strictly along the axis of the cooling pipe. They can then easily be detached later.

One embodiment of the present invention will now be specified with respect to the accompanying drawing, wherein

DESCRIPTION OF THE PREFERRED EMBODIMENTS

Figure 1:
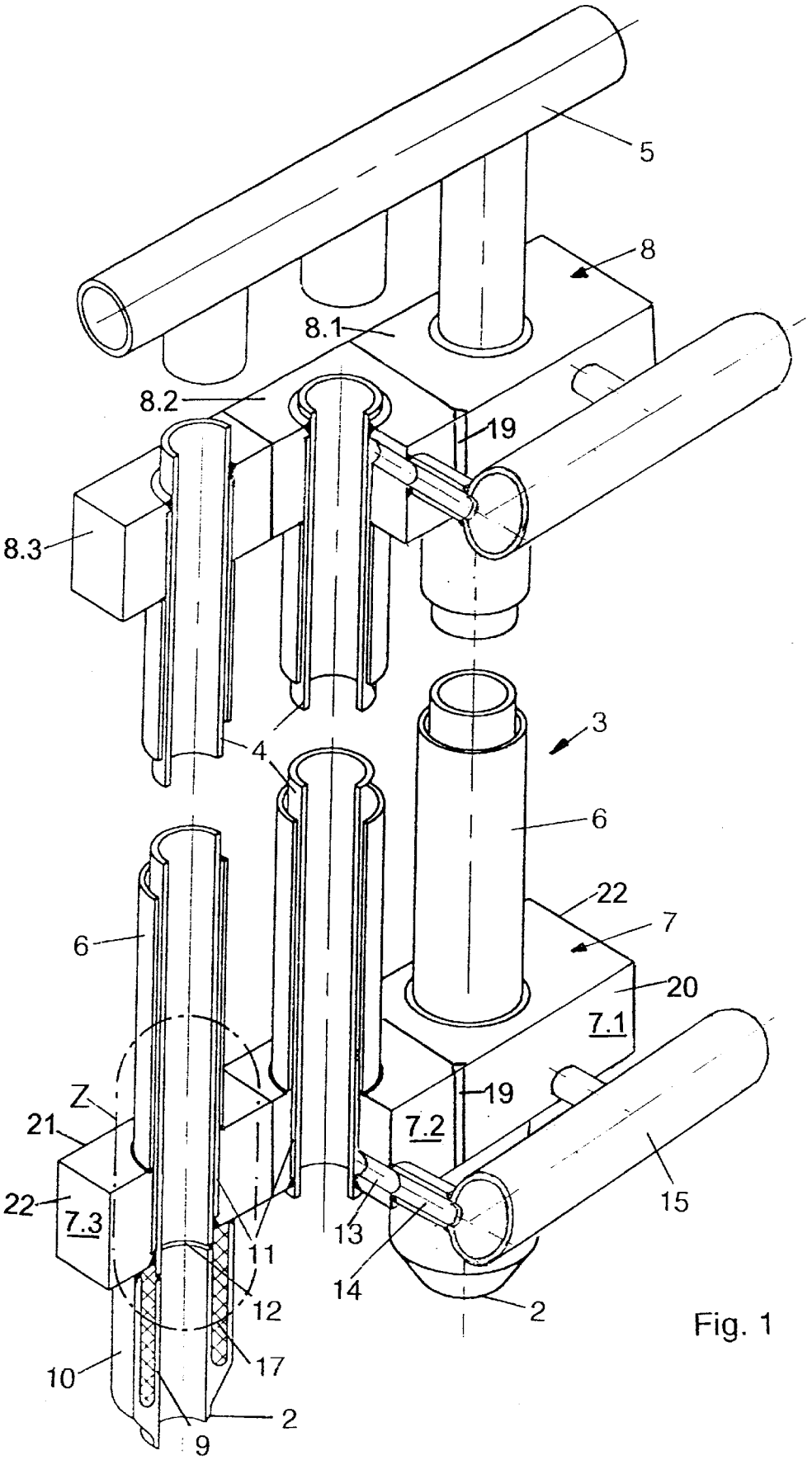
FIG. 1 is a perspective view of a cracked-gas cooler.
Figure 2:
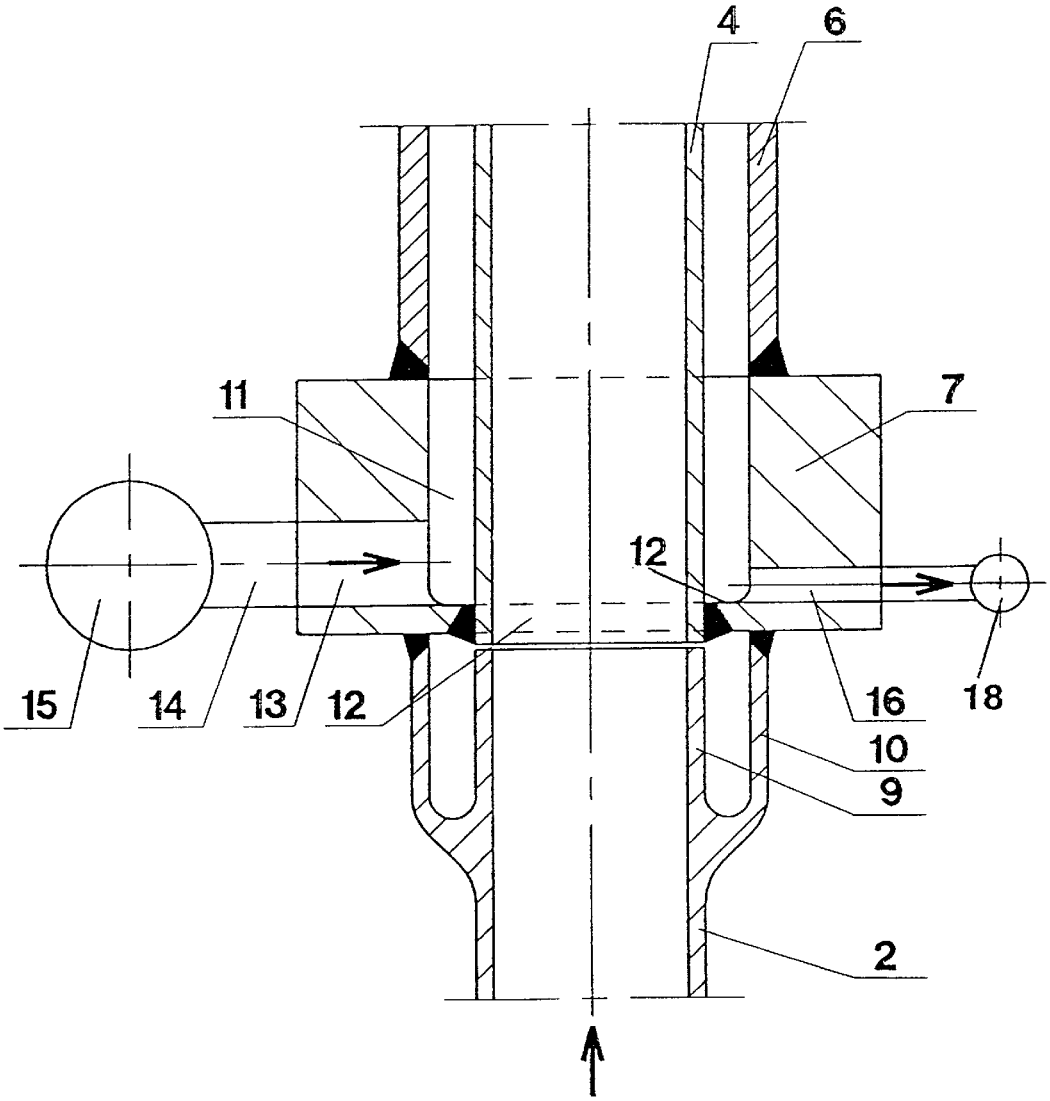
FIG. 2 is a longitudinal section through the lower water chamber of a cracked-gas cooler.
Figure 3:
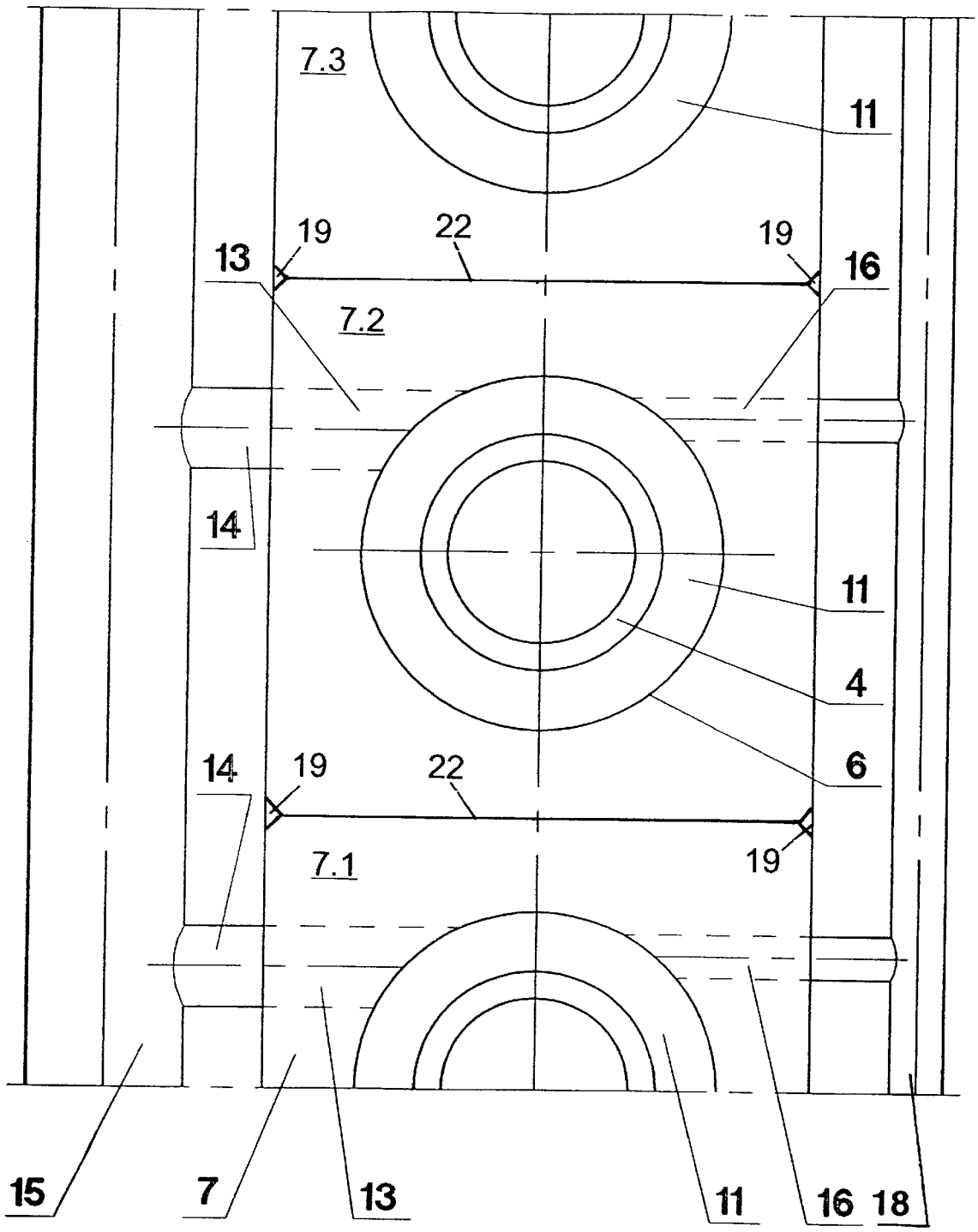
FIG. 3 is a top view of the chamber illustrated in FIG. 2.

Gas is cracked in a furnace by treating hydrocarbons with steam. The furnace is provided with gas-cracking pipes 2.

The starting material flows through pipes 2, which are heated from outside. The cracked gas leaves gas-cracking pipes 2 at a temperature of 800° to 850° C. and immediately enters a cracked-gas cooler 3 in the direct vicinity and above the furnace. The molecular composition of the gas is stabilized in cooler 3 by rapid cooling through the exchange of heat with highly compressed and evaporating water.

Cooler 3 comprises several cooling pipes 4. Cooling pipes 4 are arrayed adjacent to each other, and each communicates with a concentrically aligned gas-cracking pipe 2. The inside diameter of each gas-cracking pipe 2 is generally the same as that of its associated cooling pipe 4. Cooling pipes 4 open into a cooled-gas header 5. Each cooling pipe 4 is concentrically accommodated in an outer pipe 6, leaving an annular gap between them. There is a water chamber 7 at one end of outer pipes 6 and another water chamber 8 at the other end. Water chamber 7 supplies, and water chamber 8 receives, the coolant.

The outlet end of each gas-cracking pipe 2 is doubled, resulting in an inner pipe wall 9 and an outer pipe wall 10. Inner pipe wall 9 constitutes an extension of gas-cracking pipe 2. Walls 9 and 10 are connected at one end. Outer pipe wall 10 is welded to lower water chamber 7. The inner pipe wall 9 of gas-cracking pipe 2 is axially very near cooling pipe 4. The space between inner pipe wall 9 and outer pipe wall 10 is packed with heat insulation 17.

Water chamber 7 and water chamber 8 are each straight and solid. Lower water chamber 7 is divided into sections 7.1, 7.2. and 7.3, and upper water chamber 8 into sections 8.1, 8.2, and 8.3. Each section has a front 20, a back 21, and two sides 22. Machined into each section 7.1, 7.2. & 7.3 and 8.1, 8.2, & 8.3 is a depression 11. A cooling pipe 4 extends through each depression 11. The end of outer pipe 6 which faces [sic] from gas-cracking pipe 2 is welded to lower water chamber 7. The inside diameter of outer pipe 6 matches the diameter of depression 11 at the weld. This diameter can be constant all the way through the depression. Depression 11 can alternatively be wider half-way through, wider, that is, than the inside diameter of outer pipe 6 by the distance between cooling pipe 4 and the outer pipe.

Depressions 11 extend far enough into water chambers 7 and 8 to leave an annular base 12 with a thinner residual wall. Cooling pipe 4 is welded into annular base 12. The area of base 12 is demarcated by the outside diameter of cooling pipe 4 and the diameter of depression 11.

A bore 13 extends, preferably tangentially, into each depression 11 at the level of base 12. Each bore 13 communicates with a coolant-supply line 15 by way of a connection 14. The coolant travels through bore 13 and into depression 11 very rapidly, generating a turbulent flow around cooling pipe 4. This flow facilitates the cooling of the base 12 of depression 11 and accordingly prevents particles from precipitating onto the base and leading to detrimental local overheating.

Each depression 11 is also provided with another bore 16 that extends out of it at the level of base 12. Any particles swirled around in the turbulent coolant inside depression 11 while cooler 3 is in operation will accordingly be flushed out. Each second bore 16 communicates for this purpose with a line 18. Each line 18 is provided with an unillustrated sludge-removal valve that can be opened briefly to bleed off particle-laden coolant.

The highly compressed water employed as a coolant is introduced into the depressions 11 in lower water chamber 7 through coolant-supply line 15 and flows through the gap between cooling pipe 4 and outer pipe 6. In so doing, the water evaporates to some extent as it exchanges heat with the cracked gas flowing through cooling pipe 4 and arrives as a combination of water and saturation vapor in upper water chamber 8. From chamber 8 the combination enters an unillustrated circulatory system that also communicates with coolant-supply line 15.

Bores 13 and 16 can also be employed as inspection ports. An endoscope can for this purpose be introduced into depression 11 while the system is out of operation. The endoscope can be employed to verify the state of the depression.

The straight pieces comprising water chambers 7 and 8 can as aforesaid consist of individual sections 7.1, 7.2. & 7.3 and 8.1, 8.2, & 8.3, each provided with its own depression 11 and connected to its own cooling pipe 4 and outer pipe 6. The separate sections 7.1, 7.2. & 7.3 and 8.1, 8.2, & 8.3 abut tight together at their sides 22 and accordingly constitute a rigid module.

Sections 7.1, 7.2. & 7.3 and 8.1, 8.2, & 8.3 can be screwed together or welded, with seams 5 mm thick for example. Sections 7.1, 7.2. & 7.3 and 8.1, 8.2, & 8.3 can be welded together with seams 19 only at the edges of their fronts 20 and backs 21, in which event the seams will extend along cooling pipes 4.

Sections 7.1, 7.2. & 7.3 and 8.1, 8.2, & 8.3 can be separated later, by cutting through seams 19 for example. Once the associated connection 14 has been severed, the sections (e.g. 7.1 and 8.1) of water chambers 7 and 8 can be removed from the overall assembly with the cooling pipe and outer pipe between them for maintenance and repair.

Figure 4:
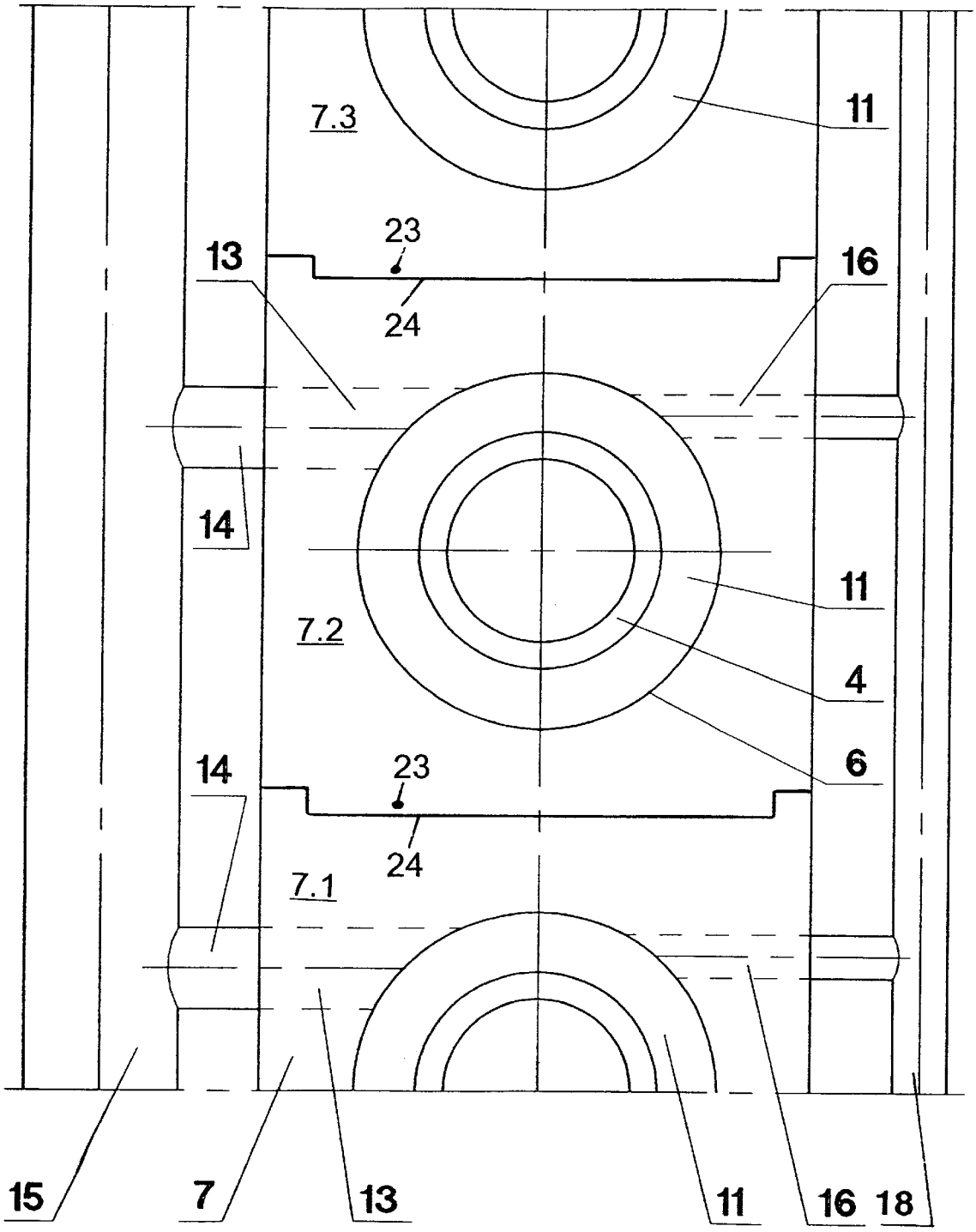
FIG. 4 is a top view of another embodiment of the chamber illustrate d in FIG. 2.

The sections 7.1, 7.2. & 7.3 and 8.1, 8.2, & 8.3 illustrated in FIG. 4 interlock. The connection consists of an elevation 23 that extends out of the center of one side 22 of each section 7.1, 1.2. & 7.3 and 8.1, 8.2, & 8.3 and along a cooling pipe 4 over the total height of the section. Elevation 23 fits into a matching recess 24 in the adjacent side 22 of the next section. This design prevents mutual displacement of sections 7.1, 7.2. & 7.3 and 8.1, 8.2, & 8.3 across cooling pipe 4. Displacement along cooling pipe 4 is impossible because it is fastened outside of the water chambers 7 and 8 constituted by sections 7.1, 7.2. & 7.3 and 8.1, 8.2, & 8.3.

I claim:

1. A heat exchanger for cooling cracked gas, comprising: a plurality of cooling pipes; a plurality of outside pipes each having an inside diameter; each of said cooling pipes being accommodated in a said outer pipe and having two ends; a water chamber having a plurality of sections; each end of said cooling pipes being welded to a section of said water chamber; said water chamber supplying and receiving a coolant and having a straight and solid component with separated round depressions therein, each of said depressions accommodating a single cooling pipe and having a diameter at least as long as said inside diameter of said outer pipe; each of said depressions having an annular base with thinner residual walls adjacent said ends of said cooling pipe; said straight and solid component comprising said water chamber; said sections of said water chamber being individual sections fastened together, each of said sections having a single depression accommodating and surrounding a cooling pipe.

2. A heat exchanger as defined in claim 1, wherein said sections are fastened together by a connection extending along said cooling pipes.

3. A heat exchanger as defined in claim 1, wherein said connection has two welded seams extending along butts between fronts and backs of adjacent ones of said sections.

4. A heat exchanger as defined in claim 1, wherein said connection comprises an elevation on one side of a section and engaging a recess in an abutting side of an adjacent section.

5. A heat exchanger for cooling cracked gas, comprising: a plurality of cooling pipes; a plurality of outside pipes each having an inside diameter; each of said cooling pipes being accommodated in a said outer pipe and having two ends; a water chamber having a plurality of sections; each end of said cooling pipes being welded to a section of said water chamber; said water chamber supplying and receiving a coolant and having a straight and solid component with separated round depressions therein, each of said depressions accommodating a single cooling pipe and having a diameter at least as long as said inside diameter of said outer pipe; each of said depressions having an annular base with thinner residual walls adjacent said ends of said cooling pipe; said straight and solid component comprising said water chamber; said sections of said water chamber being individual sections fastened together, each of said sections having a single depression accommodating and surrounding a cooling pipe; said sections being fastened together by a connection extending along said cooling pipes; said connection having two welded seams extending along butts between fronts and backs of adjacent ones of said sections; said connection comprising an elevation on one side of a section and engaging a recess in an abutting side of an adjacent section.

* * * * *